US007145540B2

(12) United States Patent
Hector et al.

(10) Patent No.: US 7,145,540 B2
(45) Date of Patent: Dec. 5, 2006

(54) DISPLAY DEVICE WITH VARIABLE-BIAS DRIVER

(75) Inventors: Jason R. Hector, Redhill (GB); Alan G. Knapp, Crawley (GB)

(73) Assignee: Koninklijke Philips Electronics N. V., Eindhoven (NL)

( * ) Notice: Subject to any disclaimer, the term of this patent is extended or adjusted under 35 U.S.C. 154(b) by 402 days.

(21) Appl. No.: 10/317,572

(22) Filed: Dec. 12, 2002

(65) Prior Publication Data

US 2003/0112215 A1 Jun. 19, 2003

(30) Foreign Application Priority Data

Dec. 18, 2001 (GB) ..... 0130177.9

(51) Int. Cl.
*G09G 3/36* (2006.01)
*G09G 3/20* (2006.01)

(52) U.S. Cl. ..... 345/98; 345/100

(58) Field of Classification Search ..... 345/87–100, 345/204–214; 327/333
See application file for complete search history.

(56) References Cited

U.S. PATENT DOCUMENTS 5,130,829 A 7/1992 Shannon ..... 359/59
6,157,360 A 12/2000 Jeong et al. ..... 345/98
6,184,855 B1 2/2001 Kobayashi et al. ..... 345/100
6,304,241 B1 * 10/2001 Udo et al. ..... 345/96
6,373,459 B1 * 4/2002 Jeong ..... 345/100
6,747,625 B1 * 6/2004 Han et al. ..... 345/98
6,943,780 B1 * 9/2005 Van Dijk ..... 345/204
2001/0013851 A1 * 8/2001 Hashimoto et al. ..... 345/91

FOREIGN PATENT DOCUMENTS

EP 1014334 A2 6/2000

OTHER PUBLICATIONS

Patent Abstracts of Japan, Mine Hideki: "Liquid Crystal Display Device" Publication No. 09062233, Jul. 3, 1997, Application No. 07221325, Aug. 30, 1995.
Paper entitled "Adaptive Biasing CMOS Amplifiers", Degrauwe et al, IEEE Journal of Solid State Circuits, vol. SC-17, No. 3, Jun. 1982, p. 522.

* cited by examiner

*Primary Examiner*—Dennis-Doon Chow

(57) ABSTRACT

A liquid crystal display has a plurality of buffers 46 controlling a plurality of column lines. The buffers have a bias current control input 47 which is controlled, in the example by timing circuitry 50, to current during the row period for writing to each row of pixels. In particular, the row period may be divided between a drive period with a high buffer bias current and a voltage maintenance period with a lower buffer bias current.

20 Claims, 5 Drawing Sheets

DISPLAY DEVICE WITH VARIABLE-BIAS DRIVER

The invention relates to a liquid crystal display, a driver for a liquid crystal display and a method of driving a liquid crystal display.

Active matrix display devices typically comprise an array of pixels arranged in rows and columns. Each row of pixels shares a row conductor which connects to the gates of the thin film transistors of the pixels in the row. Each column of pixels shares a column conductor, to which pixel drive signals are provided. The signal on the row conductor determines whether the transistor is turned on or off, and when the transistor is turned on, by a high voltage pulse on the row conductor, a signal from the column conductor is allowed to pass on to an area of liquid crystal material, thereby altering the light transmission characteristics of the material. An additional storage capacitor may be provided as part of the pixel configuration to enable a voltage to be maintained on the liquid crystal material even after removal of the row electrode pulse. U.S. Pat. No. 5,130,829 discloses in more detail the design of an active matrix display device.

The frame (field) period for active matrix display devices requires a row of pixels to be addressed in a short period of time, and this in turn imposes a requirement on the current driving capabilities of the transistor in order to charge or discharge the liquid crystal material to the desired voltage level. In order to meet these current requirements, the gate voltage supplied to the thin film transistor needs to fluctuate between values separated by approximately 30 volts. For example, the transistor may be turned off by applying a gate voltage of around −10 volts, or even lower, (with respect to the source) whereas a voltage of around 20 volts, or even higher, may be required to bias the transistor sufficiently to provide the required source-drain current to charge or discharge the liquid crystal material sufficiently rapidly.

The requirement for large voltage swings in the row conductors requires the row driver circuitry to be implemented using high voltage components.

The voltages provided on the column conductors typically vary by approximately 10 volts, which represents the difference between the drive signals required to drive the liquid crystal material between white and black states. Various drive schemes have been proposed enabling the voltage swing on the column conductors to be reduced, so that lower voltage components may be used in the column driver circuitry. In the so-called "common electrode drive scheme", the common electrode, connected to the full liquid crystal material layer, is driven to an oscillating voltage. The so-called "four-level drive scheme" uses more complicated row electrode waveforms in order to reduce the voltage swing on the column conductors, using capacitive coupling effects.

These drive schemes enable lower voltage components to be used for the column driver circuitry. However, there is still a significant amount of complexity and power inefficiency in the column driver circuits. Each row is addressed in turn, and during the row address period of any one row, pixel signals are provided to each column. In conventional designs each column is provided with a buffer for holding a pixel in the column to a drive signal level for the full duration of the row address period.

A difficulty is that the power needed to drive the buffers may be inconveniently large, especially for low power, battery driven applications. Typically, even when not driving a line, each buffer might have a power requirement of 3.5 mW or more. This power requirement is known as the quiescent power requirement and may be distinguished from the further power required when the buffer charges the lines. The number of column lines required to drive display screens is large, and so the number of buffers needed may need to be large as well. Thus the total quiescent power requirement in prior designs may easily be too large for portable battery driven applications. It is possible to redesign buffers with a lower quiescent power requirement, but such redesign generally also lowers the ability of the buffers to deliver sufficient current to quickly charge up the column lines.

Thus, it would be generally desirable to reduce the power required to be drawn by the buffers.

According to the invention there is provided a liquid crystal display having a plurality of liquid crystal pixel electrodes arranged as an array of rows and columns; a plurality of row and column lines for driving the liquid crystal pixel electrodes; a plurality of buffers for driving the plurality of column lines, the buffers being operable at a variety of bias currents; and means for varying the buffer bias currents during a plurality of row periods, the row periods being periods for writing to a row of pixel electrodes, whilst maintaining the voltage output to provide different bias currents at different times within individual row periods.

By varying the bias current of each buffer at different times during the charging of each line, it is possible to reduce the total power consumption of the buffer, whilst still providing sufficient current to switch the column lines in the time available.

Since the capacitance of individual column lines is greater than that of individual pixel electrodes much more power is needed to charge the column lines to the required voltage than is required subsequently to maintain the voltage at the required voltage in order to charge up the pixel. Furthermore, suitable buffer amplifiers are available that have a variable current sourcing capability by varying the bias current and thus the quiescent power.

Accordingly, by varying the bias current of the buffer amplifiers to first charge up the column lines using a higher bias current and later to maintain the column lines at a given voltage using a lower bias current whilst still maintaining the voltage on the column line the amplifiers may have a considerably lower power requirement averaged over each frame than in prior arrangements.

It should be noted that the buffer bias current is not the complete current drawn by the buffer, which generally is drawn from the power supply, but varying the buffer bias current does change the ability of the buffer to source large currents.

In embodiments, the means for varying the buffer bias currents includes timing circuitry for dividing each row period into a drive period and a voltage maintenance period and controlling the buffers to use a higher bias current during a first part of the row period to charge the column lines and to use a lower bias current during a second part of the row period to maintain the voltage on the column lines.

In preferred embodiments, the period for writing each frame is divided into an addressing phase or phases including all of the row periods and a power down phase in which the buffers are inactive. It will be appreciated that this saves power, since the buffers are inactive for part of the frame time. Of course, the pixels need to be addressed more quickly than otherwise but this is achieved by the approach of the invention of varying the buffer bias current to be initially high to allow fast charging of the column lines and then lower to avoid excessive power consumption. Thus, in these preferred embodiments the buffer bias current is initially high, and then lowers whilst maintaining the voltage on the line. There is a further phase during which the buffers are substantially switched off. The further phase may for example take place after all the rows of the display have been written to, or may be a plurality of short pauses interspersed between writing to different rows.

The invention also consists of a method of operating a liquid crystal display having a plurality of rows and columns of pixel electrodes, the method comprising: converting a sequence of digital signals representing a series of image frames into a sequence of voltage levels for driving the column lines; driving the plurality of column lines from a plurality of buffers operable at a variety of bias currents during a plurality of row periods for charging each successive row of pixel electrodes; and varying the buffer bias currents during each row period to provide different bias currents at different times within individual row periods.

The invention also relates to a column driver for driving a liquid crystal display as set out above.

Specific embodiments of the invention will now be described, purely by way of example, with reference to the accompanying drawings, in which.

Figure 1:
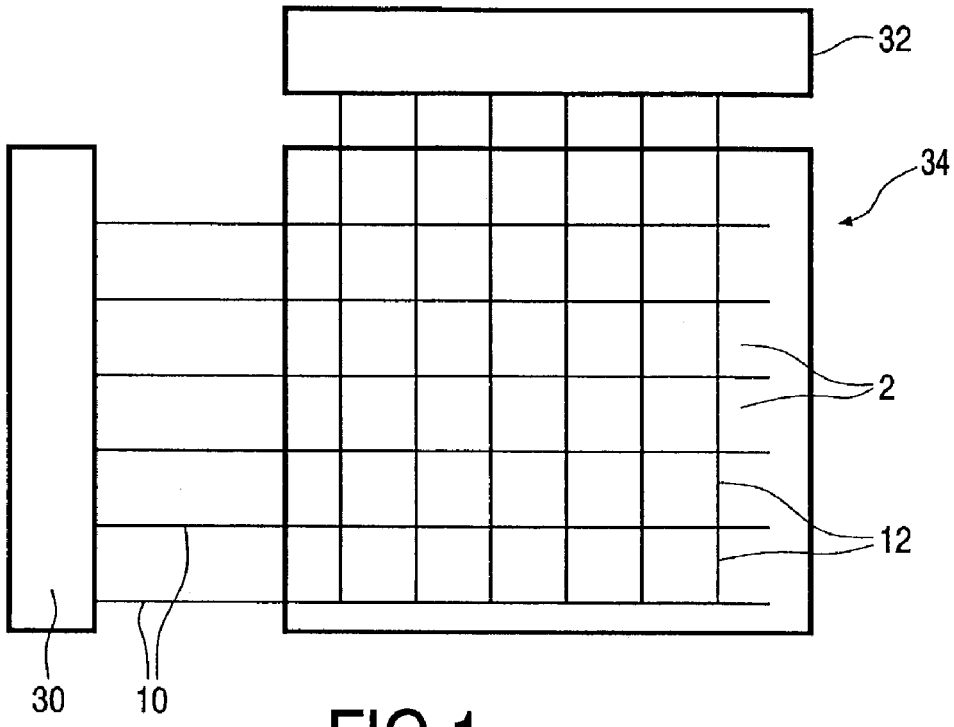
FIG. 1 shows a liquid crystal display according to a first embodiment of the invention.

It should be noted that the drawings are schematic and not to scale.

FIGS. 1 to 4 shows a pixel configuration for an active matrix liquid crystal display. The display is arranged as an array of pixels 2 in rows and columns. Each row of pixels shares a common row conductor 10, and each column of pixels shares a common column conductor 12. The row address signals are provided by row driver circuitry 30, and the pixel drive signals are provided by column address circuitry 32, to the array 34 of display pixels.

In order to enable a sufficient current to be driven through the thin film transistor 14, which is implemented as an amorphous silicon thin film device, a high gate voltage must be used. In particular, the period during which the transistor is turned on is approximately equal to the total frame period within which the display must be refreshed, divided by the number of rows. It is well known that the gate voltage for the on-state and the off-state differ by approximately 30 volts in order to provide the required small leakage current in the off-state, and sufficient current flow in the on-state to charge or discharge the liquid crystal cell 16 within the available time. As a result, the row driver circuitry 30 uses high voltage components.

Figure 2:
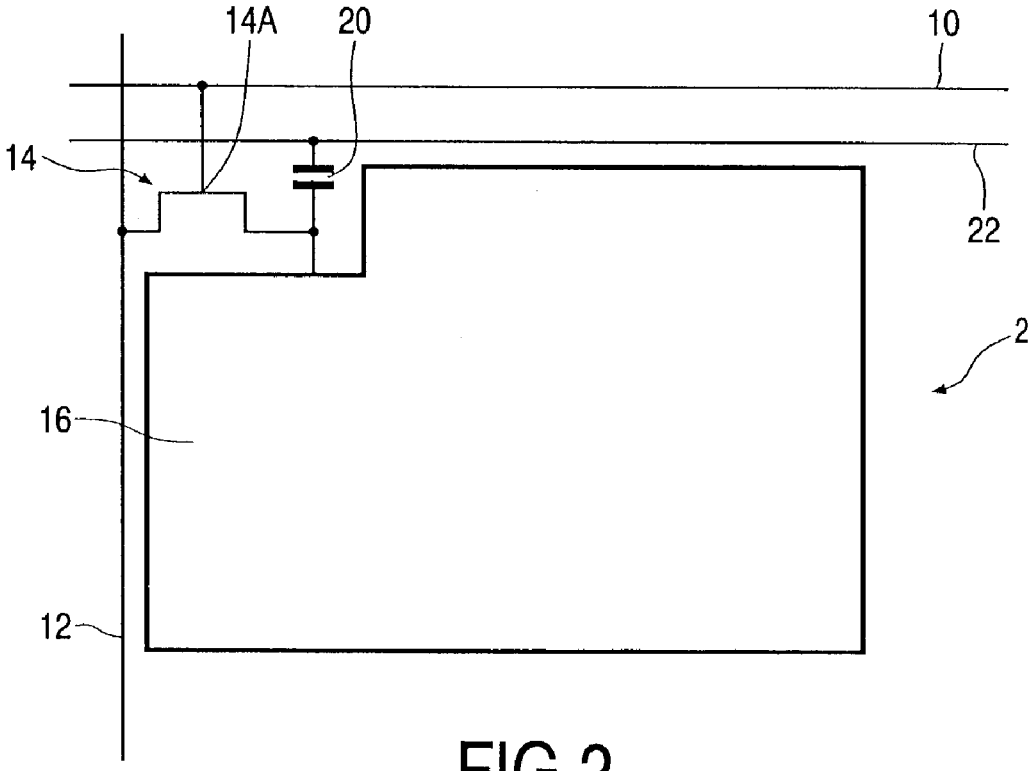
FIG. 2 shows a single pixel of the liquid crystal display of FIG. 1.

As shown in FIG. 2, each pixel comprises a thin film transistor 14 and a liquid crystal the column conductor 12. The transistor 14 is switched on and off by a signal provided on the row conductor 10. The row conductor 10 is thus connected to the gate 14*a* of each transistor 14 of the associated row of pixels. Each pixel may additionally comprise a storage capacitor 20 which is connected at one end to the next row electrode, to the preceding row electrode, or to a separate capacitor electrode 22. This capacitor 20 helps to maintain the drive voltage across the liquid crystal cell 16 after the transistor 14 has been turned off. A higher total pixel capacitance is also desirable to reduce various effects, such as kickback, and to reduce the grey-level dependence of the pixel capacitance.

Figure 3:
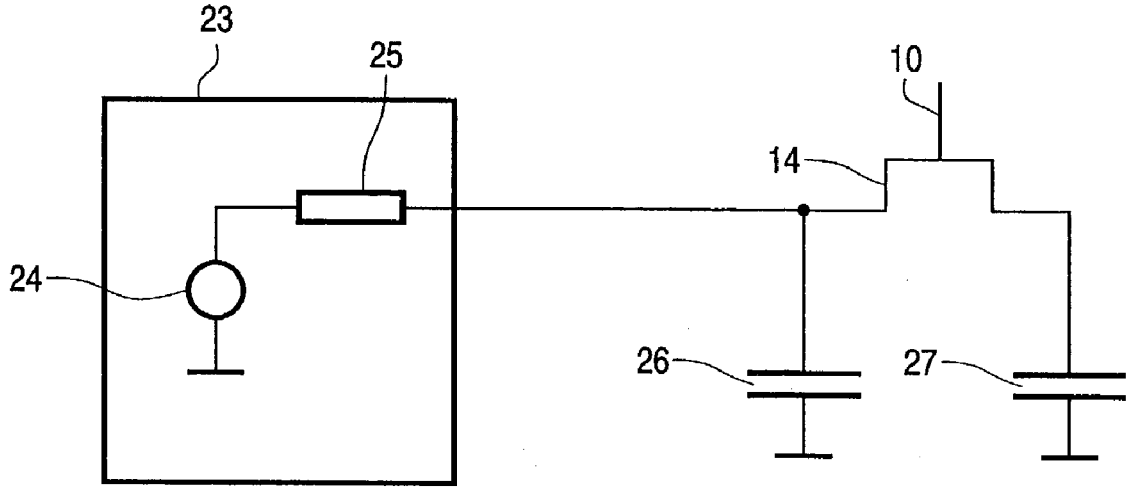
FIG. 3 is an equivalent electrical circuit diagram of the drive of a pixel of the first embodiment.

FIG. 3 shows the equivalent circuit of the connection between the column driver 23 (which essentially comprises a voltage source 24 and a switch having resistance 25) and the pixel of the column in the selected row. The column has a column capacitance 26, which results, for example, from all of the crossovers of the column with the row conductors. The individual pixel has a pixel capacitance 27 made up of the capacitance of the pixel electrode 16 and the storage capacitor 20.

Figure 4:
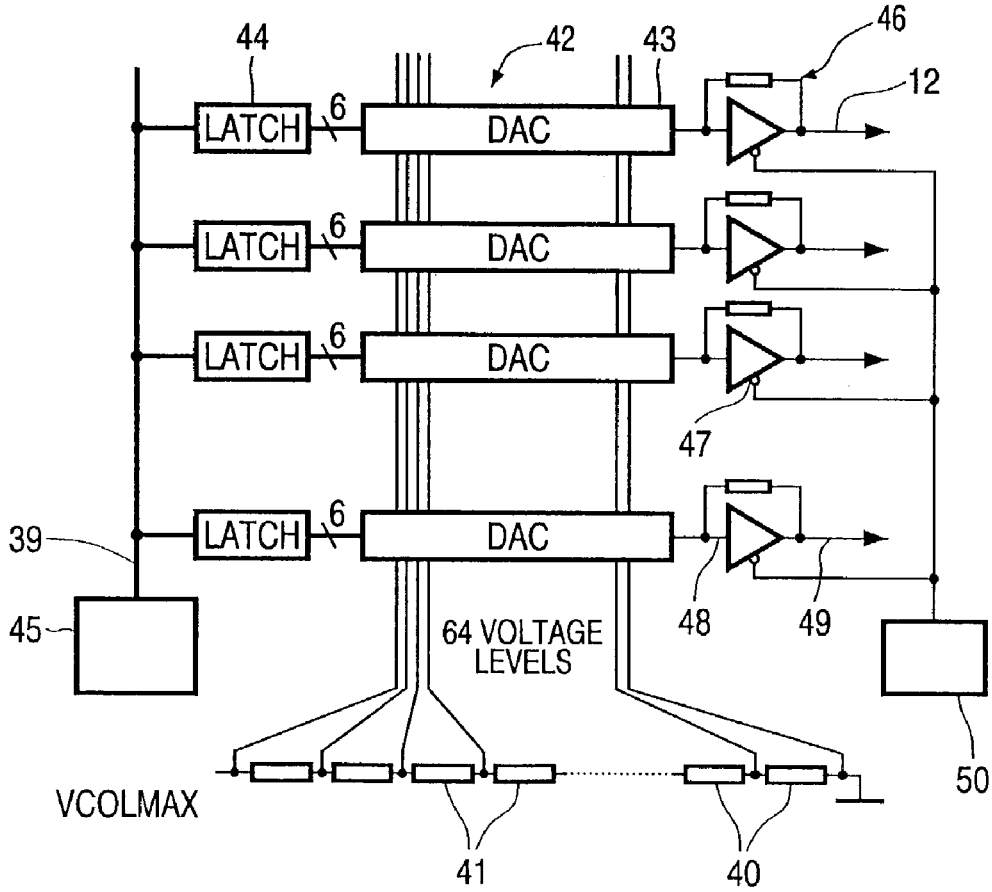
FIG. 4 shows the column drive circuitry used in the first embodiment.

FIG. 4 shows the column driver circuit for use in the first embodiment of the invention. The number n of different pixel drive signal levels are generated by a grey level generator 40, for example a resistor array including a plurality of resistors 41 arranged in series as shown. A switching matrix 42 controls the switching of the required level to each column and comprises an array of converters 43, each converter corresponding to one column line 12, for selecting one of the n grey levels based on a digital input from a latch 44. The digital input is derived from a RAM storing the required image data 45 through data input 39.

Each column line 12 is provided with a buffer 46, each of which has a bias current control input 47, a signal input 48 and a signal output 49. The signal input 48 is connected to the output from the corresponding converter 43, the signal output 49 drives the respective column, and the bias current control input 47 is connected to a timing circuit 50, the function of which will be explained in more detail below.

The bias current control input 47 controls the bias current drawn by the buffer. The buffer 46 is capable of driving its output 49 to a voltage determined by the voltage on the signal input 48 using a variety of different bias currents. The current sourcing capability of the buffer 46 varies as a function of the bias current. Buffers having an adjustable bias current are well known in the art and will not be described further.

In use, in order to drive the liquid crystal cell 16 to a desired voltage to obtain a required grey level, an appropriate signal is provided on the column conductor 12 in synchronism with a row address pulse on the row conductor 10. This row address pulse turns on the thin film transistor 14, thereby allowing the column conductor 12 to charge the pixel electrode 16 to the desired voltage, and also to charge the storage capacitor 20 to the same voltage. The column drive signal results in charging of both capacitances 26 and 27. However the time constant for charging the column capacitor 26 (resistance 25×capacitance 26) is much lower than the time constant for charging the pixel (TFT resistance×capacitance 27). Thus, a short column address pulse is required to charge the column capacitance 26.

After the column address pulse, but while the row address pulse is still active, there is charge transfer between the column capacitance 26 and the pixel capacitance 27, until an equilibrium is reached. The pixel capacitance is much smaller than the column capacitance, so that the equilibrium is reached with little change in the column voltage. The large time constant of the pixel results from the high TFT resistance. At the end of the row address pulse, the transistor 14 is turned off. The storage capacitor 20 reduces the effect of liquid crystal leakage and reduces the percentage variation in the pixel capacitance caused by the voltage dependency of the liquid crystal cell capacitance. The rows are addressed sequentially so that all rows are addressed in one frame period, and refreshed in subsequent field periods. The timing circuit 50 controls the buffer bias current of the buffers 46 by inputting a signal on the control input 47 of each of the buffers. The signal may be the bias current itself. However, in the preferred embodiment shown the signal is a voltage that controls the current drawn by the buffers in order that small variations of the input impedance of the bias current control input 47 between different buffers 46 do not cause excessive variation in the bias current drawn by the different buffers.

Figure 5:
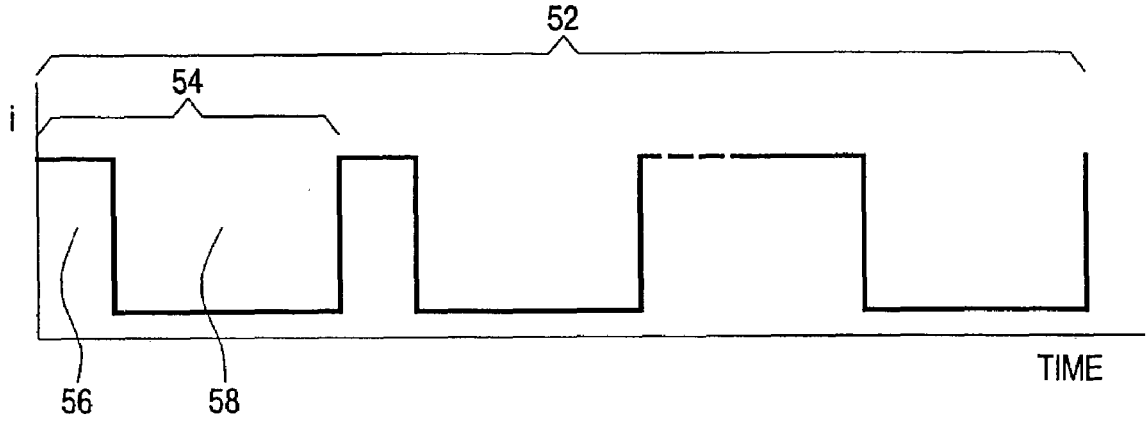
FIG. 5 shows the buffer bias currents as a function of time in the first embodiment.

FIG. 5 illustrates the timing of the buffer bias currents. The image frame period 52, i.e. the period for each successive frame of the image, is divided into a plurality of line periods 54 for charging up the pixel capacitances 27 of successive rows of pixels. It will be appreciated that once the pixel capacitances 27 of each row have been charged to a level corresponding to the required grey level, each pixel capacitance 27 will retain its charge until it is rewritten in the next frame period 52, thereby retaining the image state of the corresponding pixels.

Each line period 54 is further subdivided into a drive phase 56 and a voltage maintenance phase 58. During the drive phase 56, a higher bias current is used for the buffers and during the voltage maintenance 58 a lower bias current is used. During the drive phase 56, the higher buffer bias current ensures that the buffers 46 are capable of supplying sufficient current to charge up the corresponding column lines 12. After the drive phase 56 is over, during the voltage maintenance phase 58, a much lower buffer bias current is used that can keep the column line 12 at the required voltage without drawing excessive current.

Consider the example of a display designed for a maximum refresh rate of 60 Hz and 240 rows. The line time is given by dividing the time for one frame by the number of rows. Thus, in the example the line period is approximately 70 μs, of which 17 μs is the drive phase 56 and 53 μs is the voltage maintenance phase 58.

By driving the buffers 46 with a high bias current in the drive phase 56 and a much lesser current during the voltage maintenance phase 58 the average power taken by the buffers is reduced whilst still maintaining the ability to rapidly charge the column lines during the drive phase 56. In this phase the high bias current ensures that the buffers 46 are capable of delivering sufficient current to rapidly charge up the column lines 12.

An alternative, and generally preferred, division of the frame period is illustrated in FIG. 6. This approach may be implemented by circuitry as shown in FIGS. 1 to 4, the only difference being that the timing circuitry 50 is arranged to provide timing signals as detailed below.

The frame period 52 is subdivided into an addressing phase 60 and a power down phase 62. The addressing phase 60 includes both the drive phase 56 and the voltage maintenance phase 58; during the power down phase the buffers 46 are essentially switched off. The examples shown in FIG. 6 are for the same case of a 240 line display for operation at up to 60 Hz, as above.

Figure 6A:
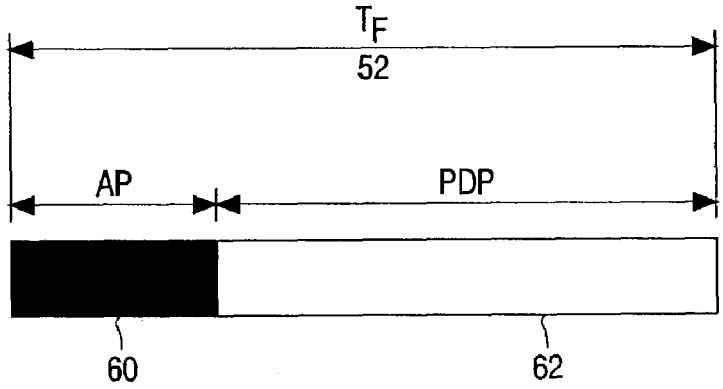
FIG. 6 shows alternative sub-divisions of the frame time.

FIG. 6 illustrates two ways in which the frame period, $T_F$, can be subdivided into addressing phase 60, AP, and power down phase 62, PDP, in which the buffer bias current is very low. FIG. 6*a* shows the frame period $T_F$ subdivided into an initial addressing phase 60 of 4.8 ms followed by a power down phase of 16.8 ms. The initial addressing phase 60 includes 240 sequential line periods 54 of 20 μs, each line period for addressing a different row of pixels. As in the example of FIG. 5, each line period 54 is divided into an initial drive phase 56 followed by a voltage maintenance phase. The drive phase 56 lasts 5 μs and the voltage maintenance phase 58 lasts 15 μs.

Figure 6B:
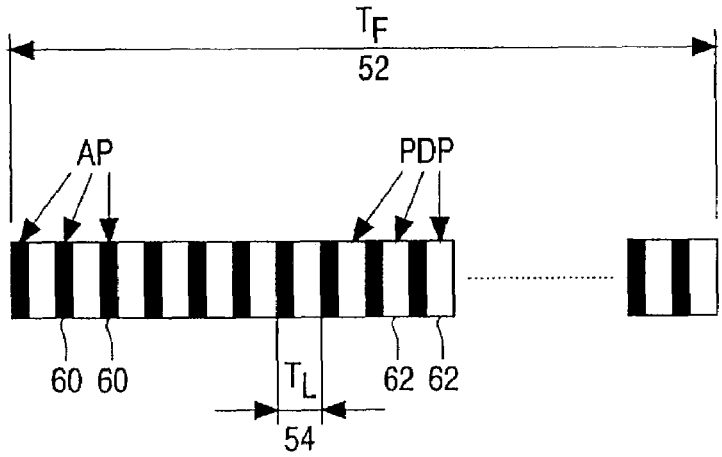

In the example of FIG. 6*b*, an alternative approach is used in which each line period 54, $T_L$, of 70 μs is subdivided into an addressing phase, AP, 60 of 20 μs followed by a power down phase, PDP, 62 of 50 μs, In which the buffer bias current is very low and the pixel is not addressed. The line period 54 is subdivided in the same manner as above into an initial drive phase 56 of 5 μs followed by a voltage maintenance phase 58 of 15 μs.

During the 5 μs initial drive phase 56 the bias current for each buffer is 3.6 μA which is sufficient bias current to allow the buffer to quickly charge the column to the desired voltage. This time is however too short to allow the selected pixel capacitance to fully charge through the TFT 14. Thus, the voltage maintenance phase 58 is used to allow the pixel capacitance 27 to charge through the TFT 14. During this time the bias current is reduced to a low value of 0.4 μA which allows the buffer to stay stable and to keep the column fully charged if there are any leakages. The buffer is still of low impedance even with this reduced bias current.

The average bias current during the addressing phase is 1.2 μA, which corresponds to a power of 6.6 μW per buffer from a 5.5V power line. The total power during the addressing phase is thus 3.5 mW. Averaged over the complete frame time, the resulting power consumption is thus 1 mW, an excellent result.

The use of a power down phase requires that the addressing takes place more quickly than would otherwise be the case. This increase in speed of addressing is made possible by dividing the addressing phase into a plurality of line driving periods and dividing the line driving periods into a drive phase 56 with a high bias current and a voltage maintenance phase 58 with a lower bias current. It should be noted that if the average bias current of 1.2 μA were used throughout the addressing phase 60 rather than subdividing the addressing phase into drive phase 56 and voltage maintenance phase 58 the level of current would probably be too slow to charge the column effectively and rapidly.

Figure 7:
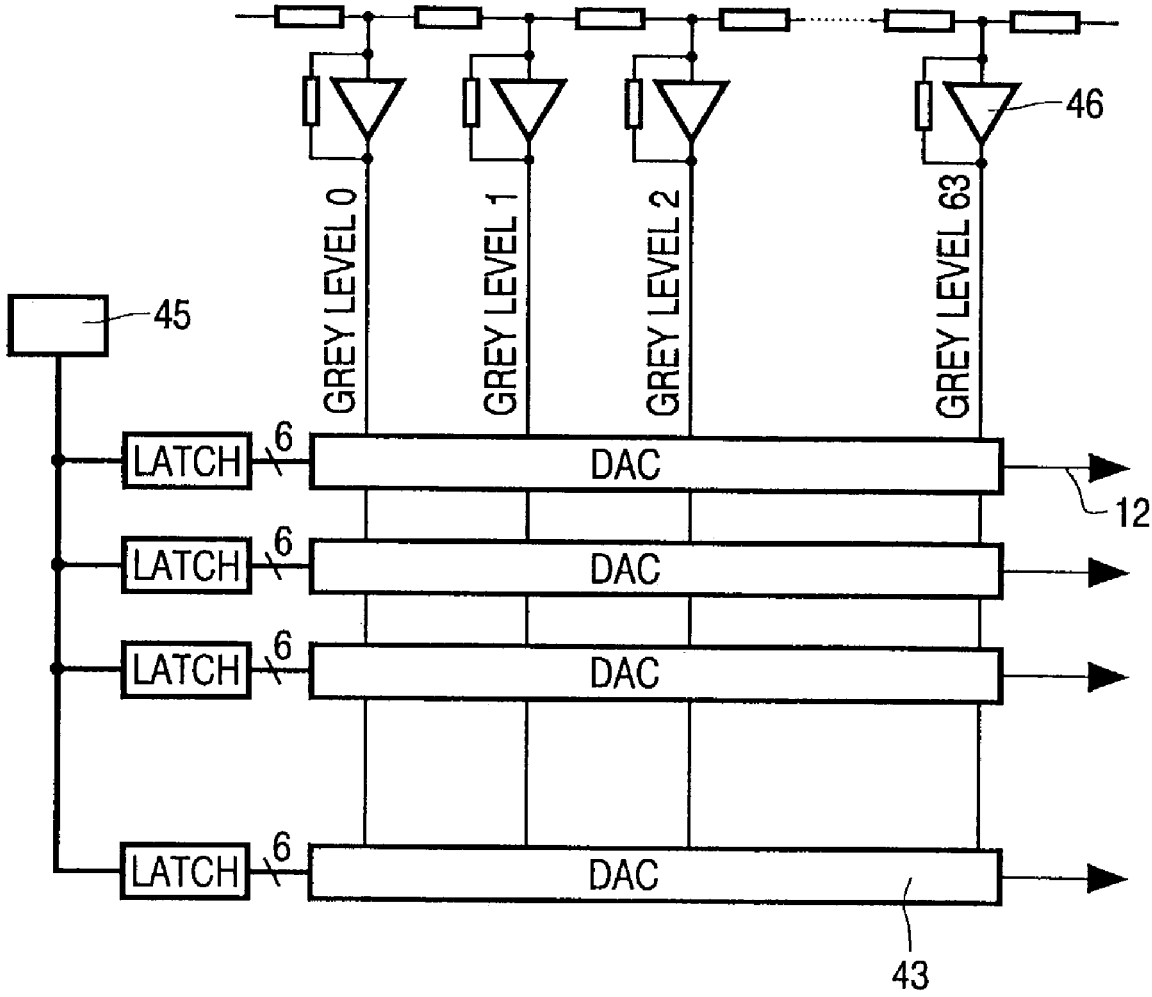
FIG. 7 shows an alternative column drive circuit according to a second embodiment.

The invention is not limited to operation with the hardware architecture illustrated above in FIGS. 1 to 4. FIG. 7 illustrates an alternative architecture which uses one buffer 46 per grey level. In this approach, instead of having one buffer 46 for each column line 12, there is one buffer 46 for each grey level. When a pixel and hence a column is required to have a given grey level the column is simply connected by respective converter 43 to the appropriate buffer 46. The digital input is derived from a RAM 45 storing the required image data which is piped to the latches.

This scheme reduces the total number of buffers to 64 for a six-bit grey scale approach. A further benefit is that the matching of different buffers becomes much less critical than in the architecture of FIG. 4.

Again the biasing of the buffer may be varied during the frame. The buffer bias current is initially high and then reduced to maintain the voltage on the column lines 12 without using excessive power.

Figure 8:
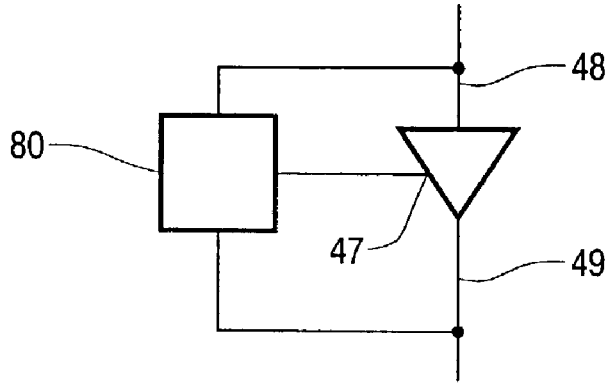
FIG. 8 shows a buffer circuit used in the second embodiment.

There are a number of possibilities for coping with the variable load on the buffers 46 depending on the number of column lines 12 connected to each of the buffers. One approach is to use adaptive biasing buffer circuits in which the buffer bias current varies in a controlled fashion. This is illustrated schematically in FIG. 8. A control circuit 80 senses the difference between the input and output voltages and also senses the rate of chance of the input voltage. The control circuit then adapts the buffer bias current depending on these parameters. The higher the rate of change of the input voltage, and the greater the difference between input and output voltages, the higher the buffer bias current. The control circuit 80 thus operates as a conventional PID (proportional-integral-differential) controller, although for simplicity the control circuit 80 may avoid any integral term.

Suitable adaptive bias circuits are known, for example from Degrauwe et al "Adaptive Biasing CMOS Amplifiers" IEEE Journal of Solid-State Circuits, Vol SC-17, No 3, Jun. 1982, starting at page 522, and accordingly will not be described further.

Figure 9:
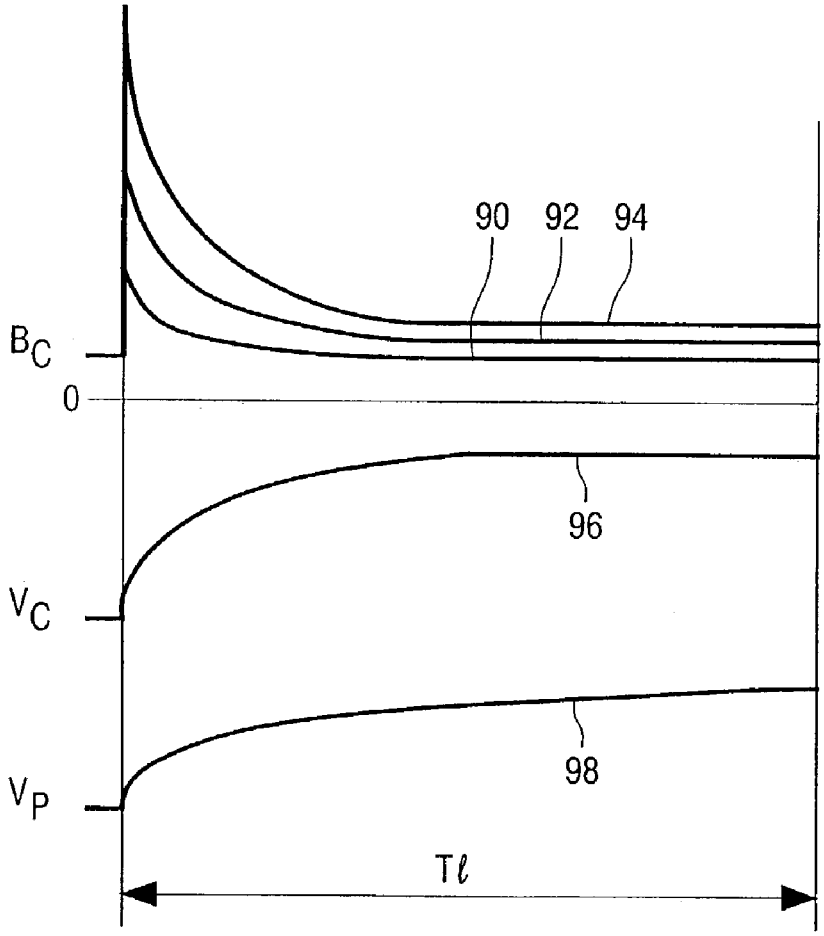
FIG. 9 shows the buffer current as a function of time in the second embodiment.

FIG. 9 illustrates the output as a function of time for a variety of different numbers of columns connected to a buffer. Curve 90 shows the buffer output current, BC, for a single column connected to the buffer, curve 92 for two columns connected to the buffer, and curve 94 for three columns connected to the buffer. $V_C$ is the column voltage and $V_P$ is the pixel voltage. As may be seen from inspection of the curves, the buffer bias current is controlled to be initially large and then reduce to quickly charge up the columns and then maintain the charge. The larger the number of columns connected to a buffer, the larger the initial size of the buffer bias current. The bias current is controlled such that the column voltages are as shown in curve 96 and the pixel voltages accordingly as shown in curve 98.

Instead of automatically sensing the load using control circuit 80, alternative embodiments of the invention may program the control circuit 80 to control the bias current of the different buffers based on the information taken from the memory 45.

From reading the present disclosure, other variations and modifications will be apparent to persons skilled in the art. Such variations and modifications may involve equivalent and other features which are already known in the design, manufacture and use of semiconductor devices and which may be used in addition to or instead of features described herein.

The invention claimed is:

1. A liquid crystal display comprising:
- a plurality of liquid crystal pixel electrodes arranged as an array of rows and columns;
- a plurality of row and column lines for driving the liquid crystal pixel electrodes;
- a plurality of buffers for driving the plurality of column lines based on data values, the buffers being operable at a variety of bias currents; and
- a controller for varying the buffer bias currents to provide different bias currents at different times within individual row periods, independent of the data values.

2. The liquid crystal display of claim 1, wherein
- the buffers include bias current control inputs and
- the means for varying the buffer bias currents comprises timing circuitry connected to the bias current control inputs for
  - dividing each row period into a drive period and a voltage maintenance period and
  - controlling the buffers
    - to use a higher bias current during the drive period to charge the column lines and
    - to use a lower bias current during the voltage maintenance period to maintain the voltage on the column lines.

3. The liquid crystal display of claim 2, wherein
- the timing circuitry controls the buffers to have
  - an addressing phase or phases including all of the row periods and
  - a power down phase in which the buffers are inactive.

4. The liquid crystal display of claim 3, wherein the plurality of buffers output a plurality of predetermined voltage levels and further comprising a switch matrix acting as a digital to analogue converter between the plurality of buffers and the plurality of column lines.

5. The liquid crystal display of claim 2, wherein the plurality of buffers output a plurality of predetermined voltage levels and further comprising a switch matrix acting as a digital to analogue converter between the plurality of buffers and the plurality of column lines.

6. The liquid crystal display of claim 1, wherein
- the buffers each have a bias current control input for controlling the bias current.

7. The liquid crystal display of claim 6, wherein the plurality of buffers output a plurality of predetermined voltage levels and further comprising a switch matrix acting as a digital to analogue converter between the plurality of buffers and the plurality of column lines.

8. The liquid crystal display of claim 1, wherein
- each buffer has a signal input and output,
- the output being connected to drive a respective column line and
- the signal input being connected to a digital to analogue conversion means.

9. The liquid crystal display of claim 8, including
- a voltage source having a plurality of outputs supplying a respective plurality of voltage levels,
- wherein
- the digital to analogue conversion means is a switch matrix for connecting the signal input of each of the buffers to the one of the plurality of outputs of the voltage source having a voltage level corresponding to the input digital signal.

10. The liquid crystal display of claim 1, wherein
- the plurality of buffers output a plurality of predetermined voltage levels and
- the liquid crystal display further comprises:
  - a switch matrix acting as a digital to analogue converter between the plurality of buffers and the plurality of column lines.

11. A method of operating a liquid crystal display having a plurality of rows and columns of pixel electrodes driven by row and column lines, the method comprising:
- converting a sequence of digital signals representing a series of image frames into a sequence of voltage levels for driving the column lines, based on image data values;
- driving the plurality of column lines from a plurality of buffers operable at a variety of bias currents during a plurality of row periods, the row periods being periods for charging each successive row of pixel electrodes; and
- varying the buffer bias currents during each row period to provide different bias currents at different times within individual row periods, independent of the image data values.

12. The method of claim 11, including
- dividing each row period into a drive period and a voltage maintenance period and
- controlling the buffer to use a higher bias current during the drive period and to use a lower bias current during the voltage maintenance period.

13. The method of claim 11, wherein the period for writing each frame is divided into an addressing phase or phases including all of the row periods and a power down phase or phases in which the buffers are switched off.

14. A liquid crystal display driver comprising:

a digital input for accepting a sequence of digital signals representing data values in a series of image frames;

digital to analogue conversion means for converting the data values of the sequence of digital signals on the digital input and outputting corresponding voltage levels;

a plurality of buffers for driving a plurality of column lines of the liquid crystal display during a plurality of row periods for writing to each row of pixel electrodes, the buffers being operable at a variety of bias currents; and means for varying the buffer bias currents to provide different bias currents at different times within individual row periods, independent of the data values.

15. The liquid crystal display driver of claim 14, wherein the means for varying the buffer bias currents comprises timing circuitry for dividing each row period into a drive period and a voltage maintenance period and controlling the buffers to use a higher bias current during the drive period to charge the column lines using a higher bias current and to use a lower bias current during the voltage maintenance period.

16. A liquid crystal display comprising:

a plurality of liquid crystal pixel electrodes arranged as an array of rows and columns;

a plurality of row and column lines, operably coupled to the liquid crystal pixel electrodes;

a plurality of buffers that are configured to drive the plurality of column lines, the buffers being operable at a variety of bias currents; and a controller that is configured to:

sequentially select rows for activation, each row being selected for a defined row-period, vary the bias currents of the plurality of buffers to provide the variety of bias currents during each row-period, independent of data values contained in the buffers.

17. The liquid crystal display of claim 16, wherein the controller is configured to vary the bias currents so as to provide:

a first bias current of the variety of bias currents during periods for writing to a row of the pixel electrodes, and a second bias current of the variety of bias currents that is lower than the first bias current at other times.

18. The liquid crystal display of claim 17, wherein the controller is further configured to vary the bias currents so as to provide a third bias current of the variety of bias currents that is lower than second bias current during a period in which the buffers are inactive.

19. The liquid crystal of claim 16, further including a plurality of digital to analog converters that are configured to provide drive signals to the buffers, corresponding to image data.

20. The liquid crystal of claim 19, further including a voltage source with multiple outputs, operably coupled to the plurality of digital to analog converters, wherein each digital to analog converter includes a switch matrix to provide the drive signal based on the image data by selecting from among the multiple outputs of the voltage source.

* * * * *